US005941034A

United States Patent [19]

Frankfurt

[11] Patent Number: 5,941,034

[45] Date of Patent: Aug. 24, 1999

[54] MULTI-STORY APARTMENT BUILDING WITH BREEZEWAY

[76] Inventor: Eric S. Frankfurt, P.O. Box 703308, Dallas, Tex. 75370-3308

[21] Appl. No.: 08/900,002

[22] Filed: Jul. 24, 1997

[51] Int. Cl.[6] ..... E04H 1/04

[52] U.S. Cl. ..... 52/236.3; 52/33; 52/79.2; 52/79.7; 52/234; 52/236.4; 52/236.7

[58] Field of Search ..... 52/234, 236.1, 52/236.3, 236.4, 236.7, 33, 79.7, 79.4, 79.2

[56] References Cited

U.S. PATENT DOCUMENTS 3,656,266 4/1972 Tyluis .
3,750,354 8/1973 Boros .
3,830,026 8/1974 Tyluis .
4,794,747 1/1989 Yendo .
4,918,889 4/1990 Lundstrom et al. .
4,928,452 5/1990 Sacks .
5,694,725 12/1997 Kaufmann et al. ..... 52/234 X

*Primary Examiner*—Christopher T. Kent
*Attorney, Agent, or Firm*—David H. Judson

[57] ABSTRACT

A three story apartment building with a number of breezeways on the first floor allowing access through the building to the other side will be designed so as to not have breezeways on the second and third story. The second and third floors of the apartment building will be comprised of two-story apartments so that no exits will be required on the third floor as required by the building code for separate third floor apartments. Preferably, each of the entrances to a first floor unit will be within the breezeways. In addition, no breezeway will need to be incorporated on the second floor since none is required on the third level. This allows for recovery of additional floor space on the second floor in the area over the breezeway of the first floor and recovery of all the former breezeway space on the third floor.

19 Claims, 5 Drawing Sheets

MULTI-STORY APARTMENT BUILDING WITH BREEZEWAY

BACKGROUND OF THE INVENTION

1. Technical Field

This invention relates generally to building structures and more particularly to a structural design that maximizes the amount of usable floor space in multi-unit buildings, e.g., apartments.

2. Description of the Related Art

In a number of States, municipal building codes require that conventional three (3) story apartment buildings include at least two means of exit so that third floor occupants have some alternate exit route in the event that a primary route is blocked, namely in the event of a fire. Many such buildings also include so-called "breezeways." A breezeway is a corridor that runs through the building from front to rear, so as to afford occupants easy access from, for example, a parking lot, to an interior courtyard or pool on an opposite side of the apartment building. In multi-story apartments with breezeways on the first floor, additional breezeways are typically implemented on the second and third floor in order to comply with the building code exit requirements, as well as to provide symmetry.

Although the breezeway is a beneficial aspect to the tenants of an apartment building, it consumes valuable footage that can be used as rental space. This is especially true with respect to the units on the upper floors of the building.

Therefore, it would be desirable to find a way to increase the amount of rentable and usable space in a multi-unit apartment building while at the same time meeting all of the tenant and regulatory concerns and requirements imposed on developers of such structures.

The present invention solves this important problem.

SUMMARY OF THE INVENTION

It is the primary object of the invention to maximize the amount of usable (and thus rentable) floor space in a multi-level apartment building incorporating breezeways.

It is another object of the invention to maximize floor space in an apartment building while granting easy tenant and visitor access to interior courtyard areas.

It is a further object of this invention to provide new building structures that are aesthetically pleasing and functional.

Yet another object of this invention is to provide novel building structures that comply with regulatory requirements yet still maximize the rentable floor space of all units comprising the building structure.

Still another object of this invention is to develop apartment structures that are more easily leased and maintained.

Another more general object of this invention is to provide a multi-story building structure with a first floor breezeway for interior access, and that includes a maximum amount of leasable floor space for upper level units.

These and other objects of the invention are achieved by a building structure in which a two-story apartment is overlaid on top of a first floor apartment located adjacent a breezeway. In particular, a preferred building structure comprises a first floor having a plurality of units. A given number of breezeways are located on the first floor allowing access through the building to a side opposite the front of the structure. This allows tenant access to an interior courtyard or the like without having to walk all the way around an external building perimeter. Preferably, each of the entrances to a first floor unit will be within the breezeway. A given number of first floor units will abut each of the breezeways.

The second and third floors of the apartment building comprise two-story apartments to achieve the objects of the present invention. In particular, because the third story of the apartment building is not a separate unit, there is no need for the building to conform to the multi-exit requirement outlined by common, local building codes. Therefore, in a preferred embodiment, no breezeways are constructed on the third floor, and this design has the advantage of allowing full recovery of such breezeway space on the third floor, and a partial recovery of the breezeway on the intermediate floor. This allows for recovery of additional floor space on the second floor in the area over the breezeway of the first floor.

The apartment building will still have the benefits of the breezeway on the first floor for allowing access to the other side of the building, whether it will be for tenant access to the pool, a courtyard, a parking lot, or to other occupants of the apartment complex.

The foregoing has outlined some of the more pertinent objects of the present invention. These objects should be construed to be merely illustrative of some of the more prominent features and applications of the invention. Many other beneficial results can be attained by applying the disclosed invention in a different manner or by modifying the invention. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION OF THE PREFERRED EMBODIMENT

Figure 1:
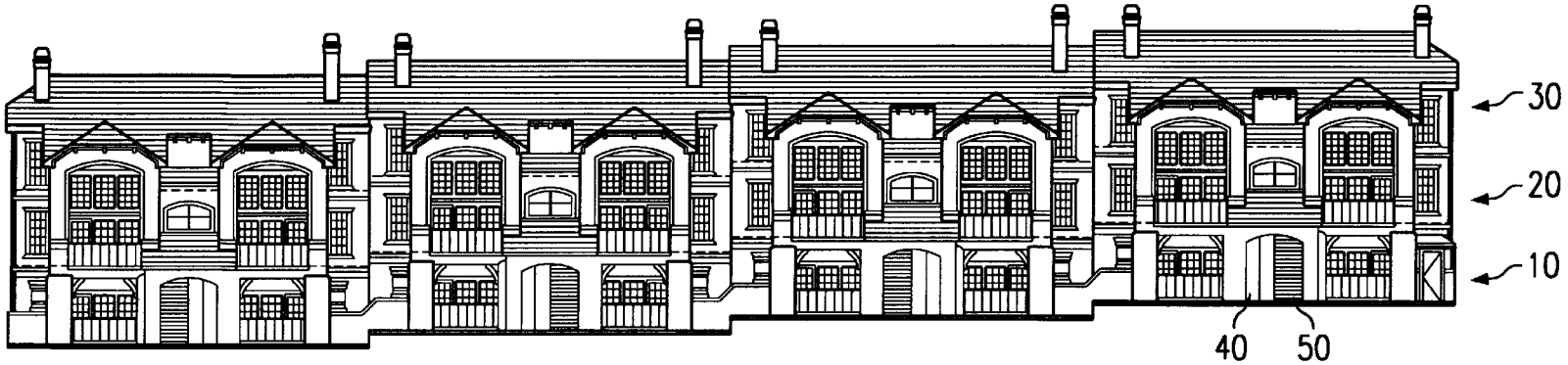
FIG. 1 is a frontal view of an apartment building with breezeways.
Figure 2A:
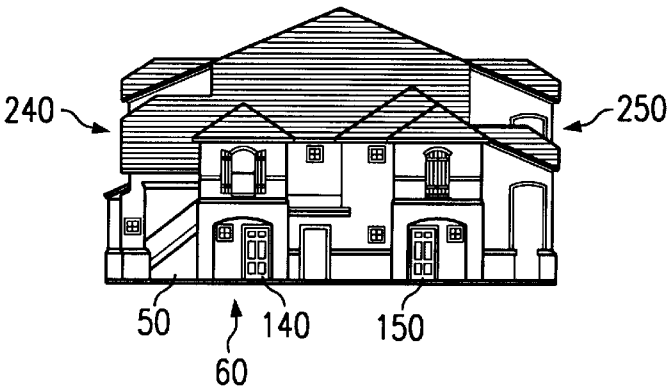
FIG. 2A is an end view of the apartment building with end additions.
Figure 2B:
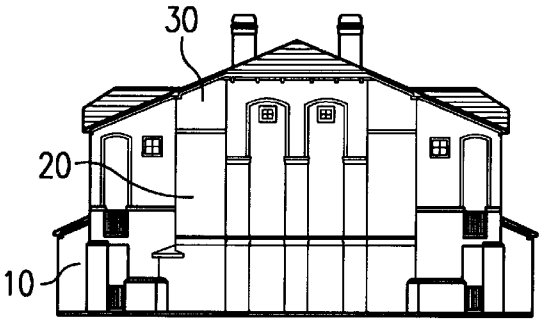
FIG. 2B is an end view of the building opposite the end view shown in FIG. 2.
Figure 2:
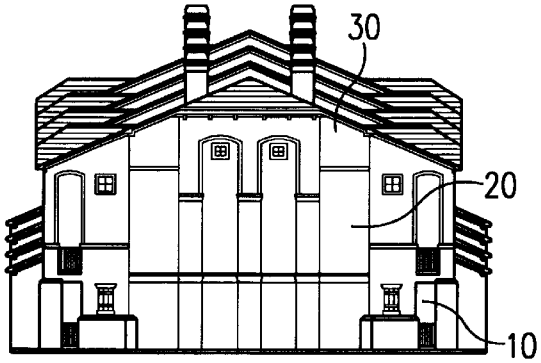
FIG. 2 is an end view of the three story apartment building.

Referring to FIG. 1, in a preferred embodiment, there is a three story apartment building 1 with a first level 10, a second level 20, and a third level 30. FIG. 2 shows the end of the three story apartment building. As used herein, the word "apartment" should be broadly construed to cover an apartment, a condominium or other rentable or usable space. Moreover, the principles of the present invention may be applicable in non-residential buildings as well.

A typical three story apartment building that incorporates breezeways through the building will have separate apartments on each floor thereby having a set of breezeways on each level to fulfill building codes. The building codes typically require that a third floor flat have two means of exit off the third floor, thereby usually forcing a third floor breezeway with access to two sets of stairs, one on each side of the building. Building codes aside, the incorporation of stacked breezeways is an inefficient use of space. If one wishes to reach the ground floor on the other side of the building from the third floor, there are multiple paths with stacked breezeways. However, all of them require basically the same walking distance. One path is to walk across the third floor breezeway and take the two flights of stairs down. Another path is to take the two flights of stairs down and then walk across the first floor breezeway. The length of each path is basically equivalent. If such is the case, it is favorable to design a building such that the redundancies in breezeways is eliminated by generating a two level apartment to occupy the second and third story.

Figure 1A:
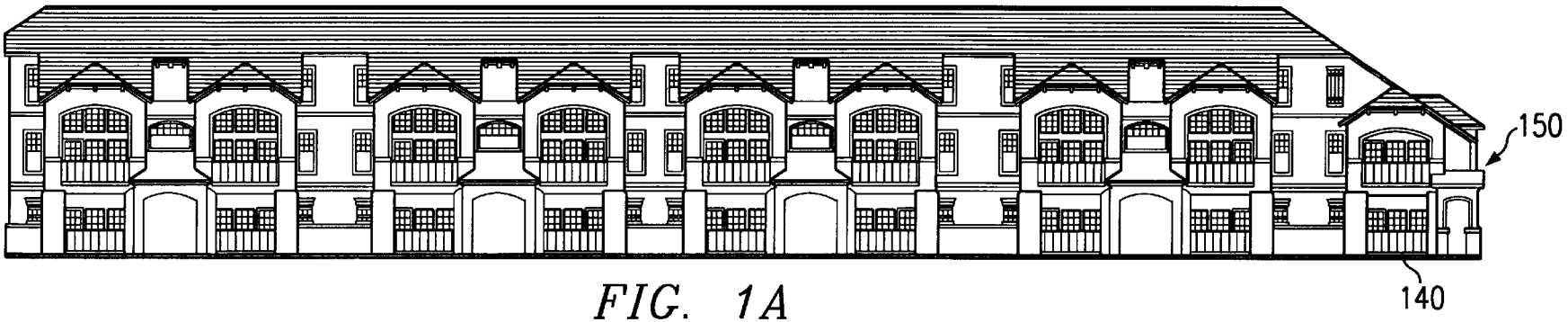
FIG. 1A is a frontal view of an apartment building with breezeways and end additions.
Figure 1B:
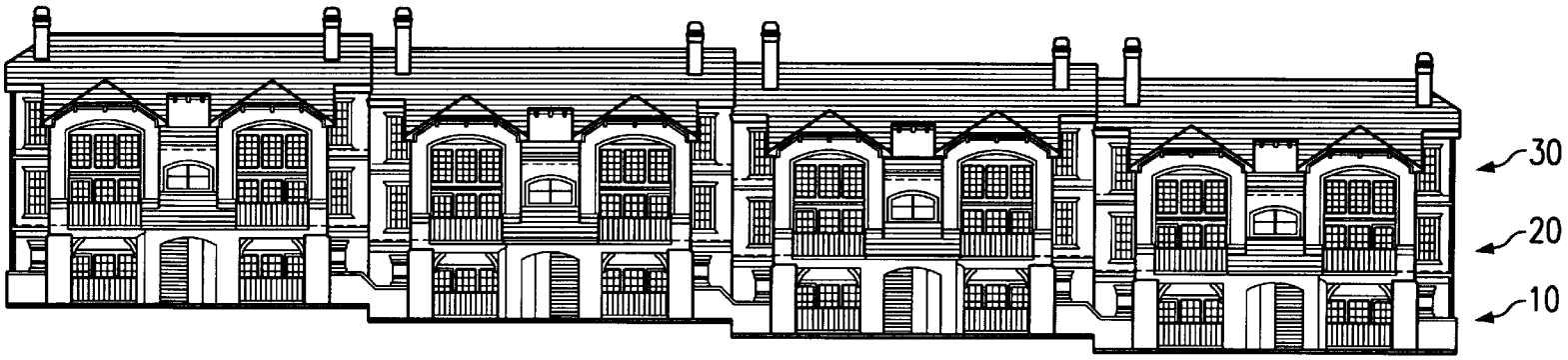
FIG. 1B is a rear view of the FIG. 1 building.

The preferred embodiment has breezeways 40 on the first level. The second level 20 has a stairwell 50 up (as seen in FIG. 1 and 2A) but does not have a breezeway that runs through the apartment building. By omitting the breezeway on the second level, the builder can incorporate more air-conditioned space within the living units on the second level while retaining a level of reasonable access for the residents of the apartment building to a parking lot or courtyard. The residents will traverse nearly the same distance by taking the stairs down and using the first floor breezeway as opposed to using a second or third level breezeway. With the elimination of the second floor breezeway, the only drawback is access to one's backside neighbors, which is a very minor factor in apartment planning, especially in light of the benefit of not having additional foot traffic and noise on the second floor breezeway. FIG. 1A is an alternative embodiment which will be discussed later. It incorporates additional apartment units at the end of the apartment building in a two story addition. FIG. 2A is the end view of the alternative apartment building that also shows the entrances 60 to the first level apartments.

Figure 3:
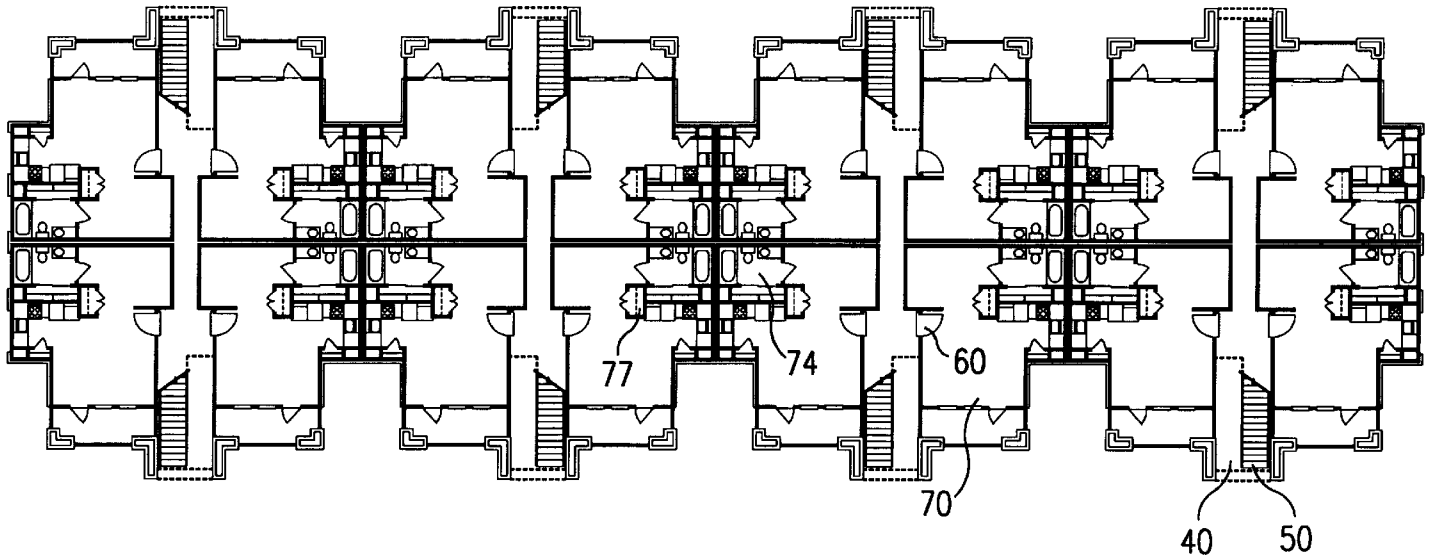
FIG. 3 is a floor plan of the first floor of the apartment building.

Referring to FIG. 3, which is a floor plan of the first level 10 of the apartment building, there are a number of single story efficiencies 70 with entrances 60 in the breezeways 40. These single story efficiencies 70 have a living area 72, a kitchen area 73, a bathroom 74, a patio 75, and a sleeping area 76. The efficiencies will also have a closet 77 which, in the alternative, can accommodate a computer.

Figure 4:
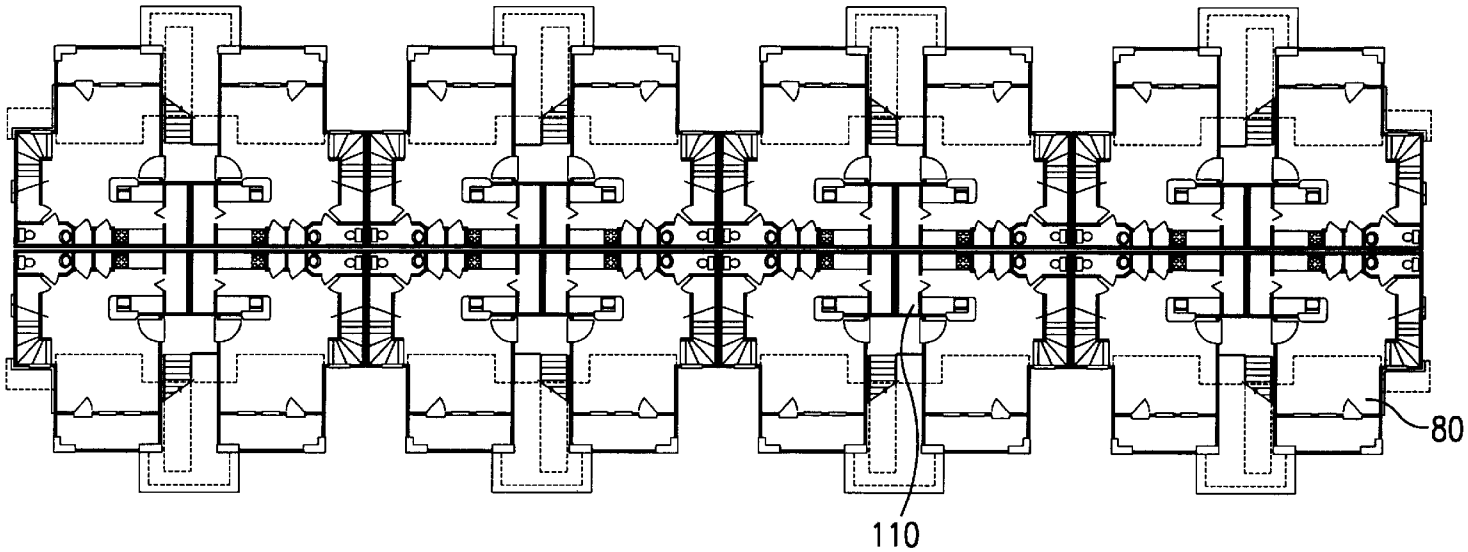
FIG. 4 is a floor plan of the second floor of the apartment building.

As seen in FIG. 4, the apartments 80 on the second story 20 are two story apartments. The first floor 20 of the second level apartment will have stairs 90 leading to the second level 30. There will be a half bathroom 84 that is over the bathroom 74 of the efficiency 70 below. There is a living area 86, a kitchen area 87, and a dining area 88. A patio 89 is accessible from the living area 86 and is directly over the lower patio 75 thereby allowing privacy for the lower patio area. The additional benefit of the overhang is that the patio door on the first floor is covered and protected from the weather elements.

In its preferred embodiment, the area that would consist of the breezeway on the first level, will be transformed into additional closet and washer/dryer space 110.

Figure 5A:
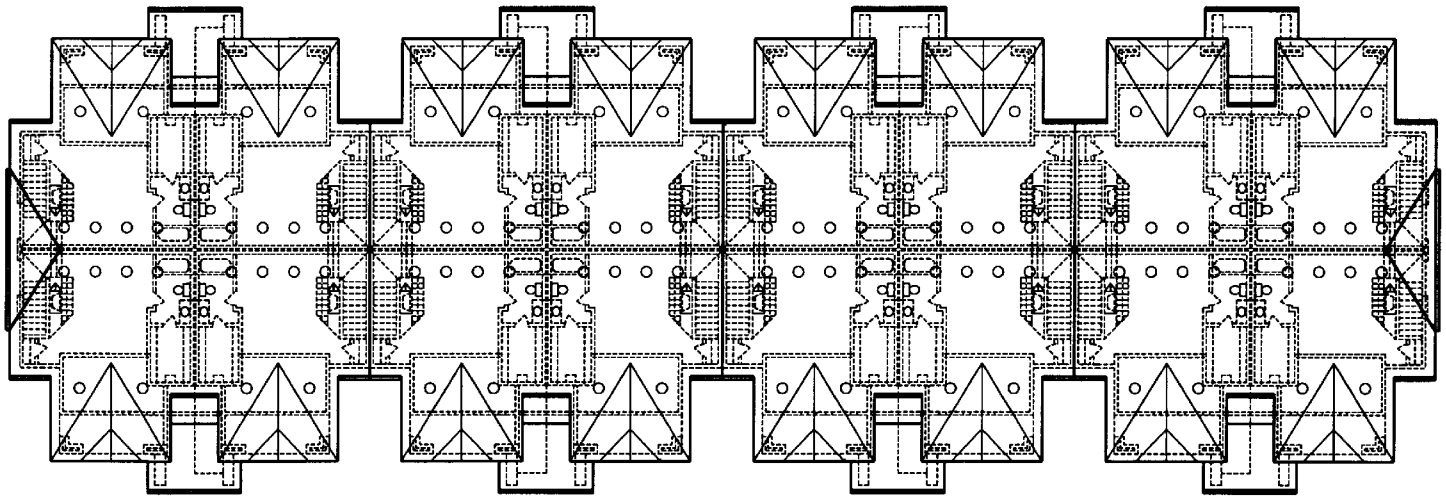
FIG. 5A is a roof plan of the apartment building.
Figure 5B:
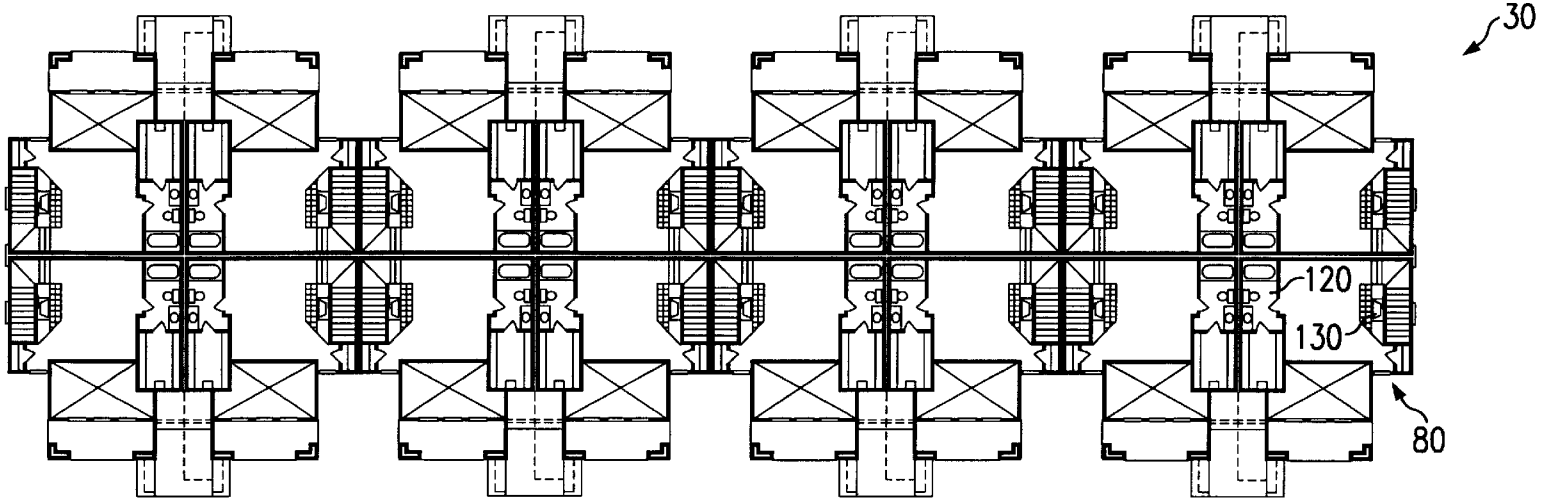
FIG. 5 is a floor plan of the third floor of the apartment building.
Figure 8:
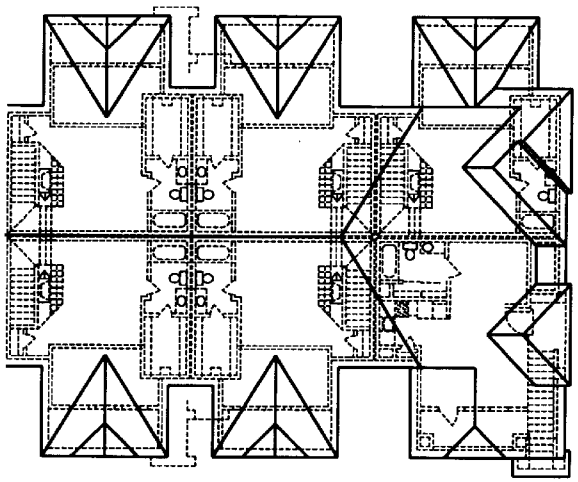
FIG. 8 is a roof plan of the addition to the end of the apartment building.

FIG. 5 shows the third story 30 of the apartment building which will be the second level of the second story apartments 80. This level, in its preferred embodiment, will have a bathroom 120 and a bedroom area with preferably a fireplace 130. The patio area on the first two levels is not implemented on the third level in this particular embodiment.

As seen in FIG. 3, the preferred embodiment of the apartment building will have 4 breezeways 40 which will translate to sixteen (16) apartment units on the first level and sixteen (16) apartments units above that for a total of thirty-two units in the apartment building.

Figure 7:
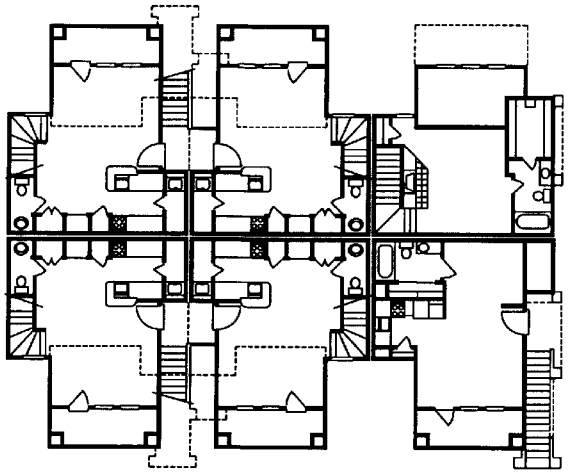
FIG. 7 is a floor plan addition to the end of the second floor of the apartment building.
Figure 6:
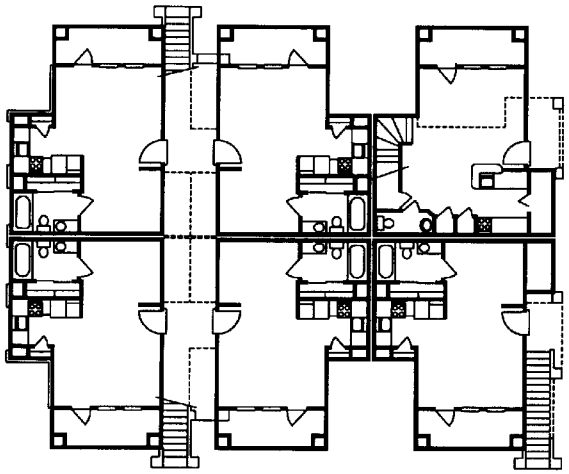
FIG. 6 is a floor plan addition to the end of the first floor of the apartment building.

An alternative embodiment can be seen in FIGS. 6 and 7 where a two level addition is added to the end of the apartment building. FIG. 6 shows a first floor efficiency 140 as well as the first level of a two story townhome 150. FIG. 7 shows the floor plan for a second story efficiency 240 as well as the second story of the two story townhome 250. If such additions are added on both ends, then the apartment building will have thirty eight units consisting of twenty one level efficiencies and eighteen two story townhomes.

By increasing the amount of enclosed footage, each unit can command a higher rental price on the market. The redundancy of having breezeways on the second and third floor are eliminated so that there is a partial recovery of space on the second floor, due to the entrance requirements and a full recovery of space on the third floor.

The present invention maximizes the square footage that can be rented out while also providing efficient access of the tenants and visitors of the apartment building. By having the second story apartments be two level townhomes, the necessity for a breezeway on the third level is eliminated.

A number of alternative embodiments are possible based on the present invention. The upper apartment does not have to be limited to a two story townhouse but can be a tri-level apartment. Also, another alternative embodiment is a four story building built up against a hill such that the ground level breezeway is actually on the second floor with two levels above it and one below it. Those skilled in the art will recognize that the invention can be practiced on other buildings and that variations, modifications and other applications will be apparent.

Having thus described our invention, what we claim as new and desire to secure by Letters Patent is set forth in the following claims:

1. A multi-story building structure having a plurality of units, comprising:

a plurality of single story units located at a ground level;

a breezeway between the single story units extending through said building at the ground level; and a plurality of multi-level units located on levels above said ground level and overlaying the single story units, each of said multi-level units having a first level which is accessible by stairs leading to the at least one breezeway and having at least one upper level such that the combined area of all of the upper levels of the multilevel units at each level occupies substantially all of that upper level of the building.

2. The building structure of claim 1 wherein the first level of the multi-level units extends at least partially over the breezeway.

3. The building structure of claim 1 wherein entrances to the single story units are in the at least one breezeway.

4. The building structure of claim 1 wherein the units are apartments.

5. The building structure of claim 1 wherein the multi-level units each include an interior stairway to facilitate access between levels of the multi-level unit.

6. A three story apartment building having a plurality of apartment units, said apartment building comprising:

a first story of single level apartment units;

at least one breezeway extending through the building on the first story; and second and third stories of two level apartment units having a first and second level, the two level apartment units being accessible via stairs leading to the at least one breezeway, wherein the combined area of the second level of the two level apartment units occupies substantially all of the third story of the building.

7. A three story apartment building having a plurality of apartment units, said apartment building comprising:

a set of at least two breezeways on a first story;

a plurality of single level apartment units on the first story; and a plurality of two level apartment units above said plurality of single level apartment units on a second and third story above said first story, the two level apartment units having a first and second level, wherein the first level of said two level apartment units are accessible via stairs leading to one of said breezeways on the ground level and wherein the combined area of the second level of the two level apartment units occupies substantially all of the third story.

8. The three story apartment building of claim 7 wherein said plurality of single level apartment units is 16 apartments.

9. The three story apartment building of claim 8 wherein said plurality of two level apartment units is 16 apartments.

10. The three story apartment building of claim 7 wherein said plurality of single level apartment units is 12 apartments.

11. The three story apartment building of claim 10 wherein said plurality of two level apartment units is 12 apartments.

12. The three story apartment building of claim 7 wherein said plurality of single level apartment units is 20 apartments.

13. The three story apartment building of claim 12 wherein said plurality of two level apartment units is 20 apartments.

14. The three story apartment building of claim 7 wherein said plurality of single level apartment units is 8 apartments.

15. The three story apartment building of claim 14 wherein said plurality of two level apartment units is 8 apartments.

16. The three story apartment building of claim 7 wherein said apartment building also comprises at least one two story end addition.

17. The three story apartment building of claim 16 wherein said two story end addition consists of one two story apartment and two one story apartments.

18. The three story apartment building of claim 16 wherein said two story end addition consists of two two story apartments.

19. The three story apartment building of claim 16 wherein said two story end addition consists of four one story apartments.

* * * * *